US006389639B1

(12) United States Patent
Worsham

(10) Patent No.: US 6,389,639 B1
(45) Date of Patent: May 21, 2002

(54) BALL WASHING APPARATUS AND METHOD

(75) Inventor: Jack W. Worsham, Greensboro, NC (US)

(73) Assignee: Intertech Corporation, Greensboro, NC (US)

( * ) Notice: Subject to any disclaimer, the term of this patent is extended or adjusted under 35 U.S.C. 154(b) by 0 days.

(21) Appl. No.: 09/429,104

(22) Filed: Oct. 28, 1999

(51) Int. Cl.[7] ..... A47L 25/00; A46B 13/04
(52) U.S. Cl. ..... 15/308; 15/302; 15/21.2
(58) Field of Search ..... 15/3.11, 3.13, 15/21.2, 302, 306.1, 308

(56) References Cited

U.S. PATENT DOCUMENTS

| | | | | |
|---|---|---|---|---|
| 3,083,389 A | | 4/1963 | Wittek | |
| 3,367,603 A | | 2/1968 | Feyerherd | |
| 3,733,633 A | | 5/1973 | Gustafson | |
| 3,820,183 A | | 6/1974 | Gustafson et al. | |
| 3,918,116 A | * | 11/1975 | Valdespino | 15/3.13 |
| 4,181,996 A | | 1/1980 | Hollrock | |
| 4,192,034 A | | 3/1980 | Knepper, Jr. | |
| 4,884,287 A | | 11/1989 | Knez | |
| 4,938,636 A | | 7/1990 | Aidlin et al. | |
| 4,970,746 A | | 11/1990 | Brackmann | |
| 5,228,168 A | | 7/1993 | Hollrock et al. | |
| 5,353,822 A | | 10/1994 | Gutterman et al. | |
| 5,361,440 A | | 11/1994 | Buchbinder et al. | |
| 5,373,597 A | | 12/1994 | Worsham | |
| 5,454,877 A | | 10/1995 | Worsham | |
| 5,529,082 A | | 6/1996 | Weimer et al. | |
| 5,551,118 A | | 9/1996 | Yeh | |
| 5,622,457 A | | 4/1997 | Thiele | |
| 5,647,089 A | | 7/1997 | Hollrock | |
| 5,669,096 A | | 9/1997 | Worsham | |
| 5,673,918 A | | 10/1997 | Bigari | |
| 5,697,116 A | * | 12/1997 | Loferer | 15/21.2 |
| 5,772,778 A | * | 6/1998 | Back | 15/21.2 |

FOREIGN PATENT DOCUMENTS

DE 264462 10/1986

OTHER PUBLICATIONS

BoingCleansing services brochure (undated) 1 page.
SOS ball maintenance truck (undated) 1 page.
The Boss Ultra Sonic Ball Washing System Presented by LAD Industries (undated) 2 pages.
Zero–Max Roh'lix Linear Actuators (undated) 4 pages.
Hollrock Engineering PIT B.O.S.S. brochure (undated) 2 pages.
Great Northwest Co. Ball Washing Machine (undated) 1 page.
GCF 2000HD brochure (undated) 2 pages.
Ball Pit Services Inc. brochure (undated) 4 pages.
Drawing of prior art ball track (undated) 1 page.
Drawings from pending patent application serial No. 09/190,995 of Jack W. Worsham filed Nov. 12, 1998.
Hygenie Ball Washer Systems brochure (undated) 1 page.
Ultraviolet Water Purification by John G. Mone, Article reprinted from Pollution Engineering Magazine vol. 5 No. 12. Dec. 1973. ©1973 by Technical Publishing Company (4 pages).
Drawings from pending patent application serial No. 29/096,389 of Jack W. Worsham filed Nov. 12, 1998.
Drawings from pending patent application serial No. 09/133,417 of Jack W. Worsham filed Aug. 13, 1998.

* cited by examiner

*Primary Examiner*—Terrence R. Till

(57) ABSTRACT

A ball washing apparatus and method for children's play pools includes a venturi assembly having a high pressure air line which brush, diaphragm and air dry balls passing through. A divider at the air line junction of the venturi assembly prevents clogging and jamming as the balls rapidly exit the ball washer through a ball return conduit. Preferably an ultraviolet light source acts as a germicide treatment for the water and balls contained within the washing chamber.

5 Claims, 4 Drawing Sheets

BALL WASHING APPARATUS AND METHOD

FIELD OF THE INVENTION

The invention herein pertains to an apparatus and method for washing play balls and particularly pertains to an apparatus used for washing lightweight polymeric balls as used in children's ball pools or pens.

BACKGROUND AND OBJECTIVES OF THE INVENTION

Ball washers are necessities with the increase in the number of children that play in ball pools which are available at commercial restaurants, playgrounds, campsites and the like. In order to maintain the balls in a clean, safe condition, ball and pool cleaning is a regular part of the maintenance now performed. Ball washing machines have been known and used for years commercially such as set forth in U.S. Pat. Nos. 5,669,096; 5,454,877 and 5,373,597.

Such prior art machines while operable, have been found to be inefficient under certain conditions. For example, previous ball washing machines have been found to jam as the ball exits the washing chamber, requiring constant surveillance during washing cycles. Other ball washing machines have required germicidal chemicals and detergents to sanitize the balls before returning them to the ball pools.

In addition, prior art washing apparatus and methods have had to operate at relatively slow speeds in order to sufficiently clean, sanitize and dry the balls before returning them to the ball pools.

Thus with the problems and disadvantages associated with prior art ball washing apparatus and methods, the present invention was conceived and one of its objectives to provide a ball washing apparatus which is both efficient and trouble-free.

It is still another objective of the present invention to provide a ball washing apparatus and method in which balls can be easily, quickly cleaned and returned to the ball pool without the ball return conduit jamming.

It is still another objective of the present invention to provide a ball cleaning method which is free of chemical germicides.

It is yet another objective of the present invention to provide a ball washing machine which as an improved, trouble-free venturi assembly which optionally rinses, brushes, diaphragms and air dries washed balls and quickly evacuates them to a return conduit.

Various other objectives and advantages of the present invention will become apparent to those skilled in the art as a more detailed description is set forth below.

SUMMARY OF THE INVENTION

The aforesaid and other objectives are realized by providing a ball washer and method for lightweight, polymeric balls typically used in children's ball pools. The washing device includes an improved washing chamber having a rotating brush and in one embodiment, an ultraviolet light source which will sanitize the water used therein without the necessity of chemical additives. The ball washing machine receives soiled balls through an entry conduit whereupon the balls are directed to a washing chamber and are scrubbed by rotating brushes in irradiated water. Upon completing the scrubbing cycle the balls are then directed upwardly by mechanical force into an exit conduit where they pass from the washing chamber into a venturi assembly. Optionally, the balls are then subjected to a rinsing action if "in-line" cleaning is performed as opposed to cleaning in "self-contained" or closed washing chambers. The balls next pass through a circular brush where excess moisture is removed and then through an elastomeric member or diaphragm which further removes remaining moisture. Next, the balls are finally dried by an air knife before passing upwardly past the high pressure air line of the venturi assembly which forces the balls from the washing machine back to the ball pool or other location as desired through a ball return conduit. The balls are prevented from jamming in the venturi assembly by a divider at the high pressure line junction which prevents misdirection of the balls and allows them to rapidly pass therethrough.

DETAILED DESCRIPTION OF THE PREFERRED EMBODIMENT AND OPERATION OF THE INVENTION

Figure 1:
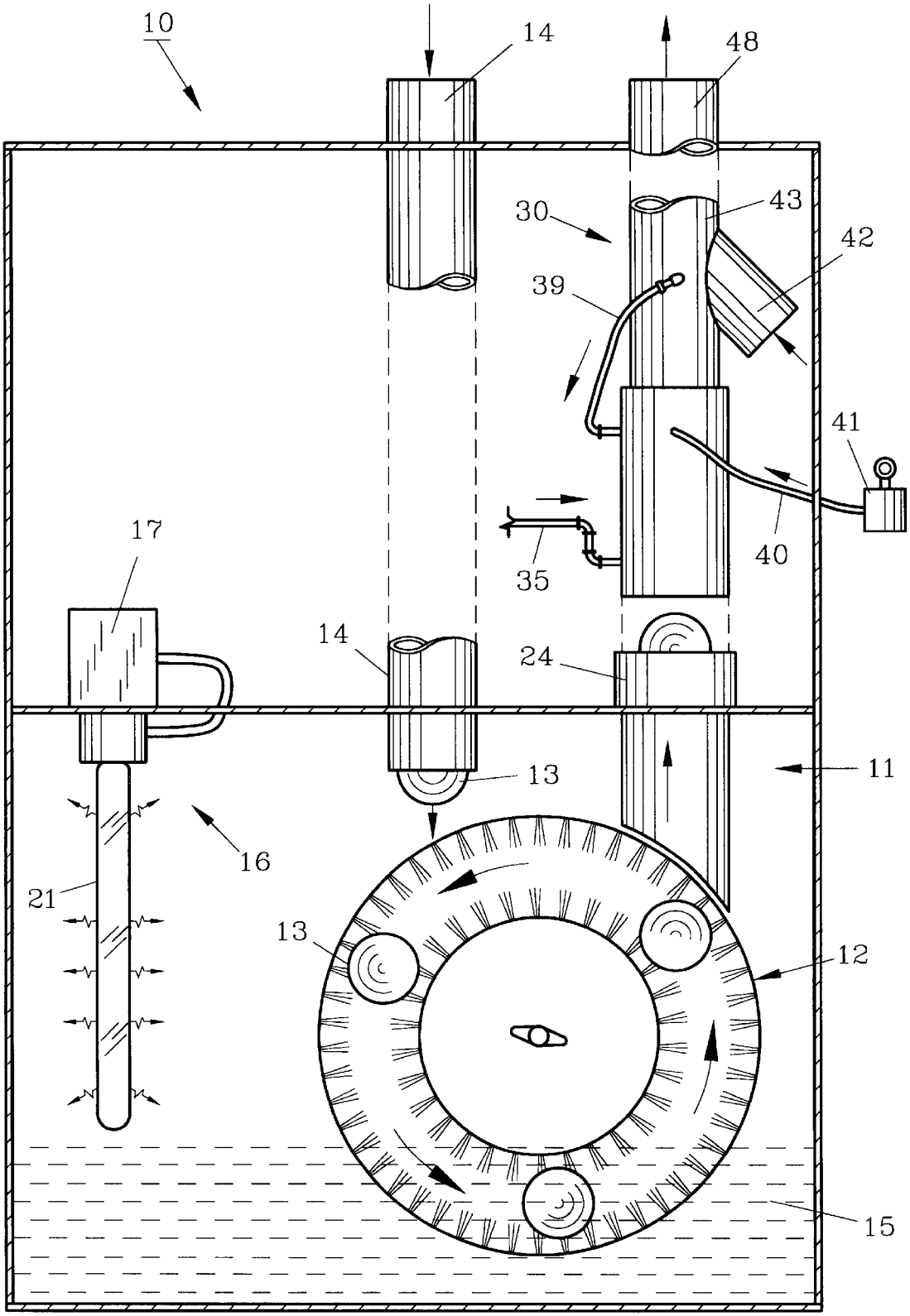
FIG. 1 shows a schematic representation of a ball washing machine of the invention.
Figure 7:
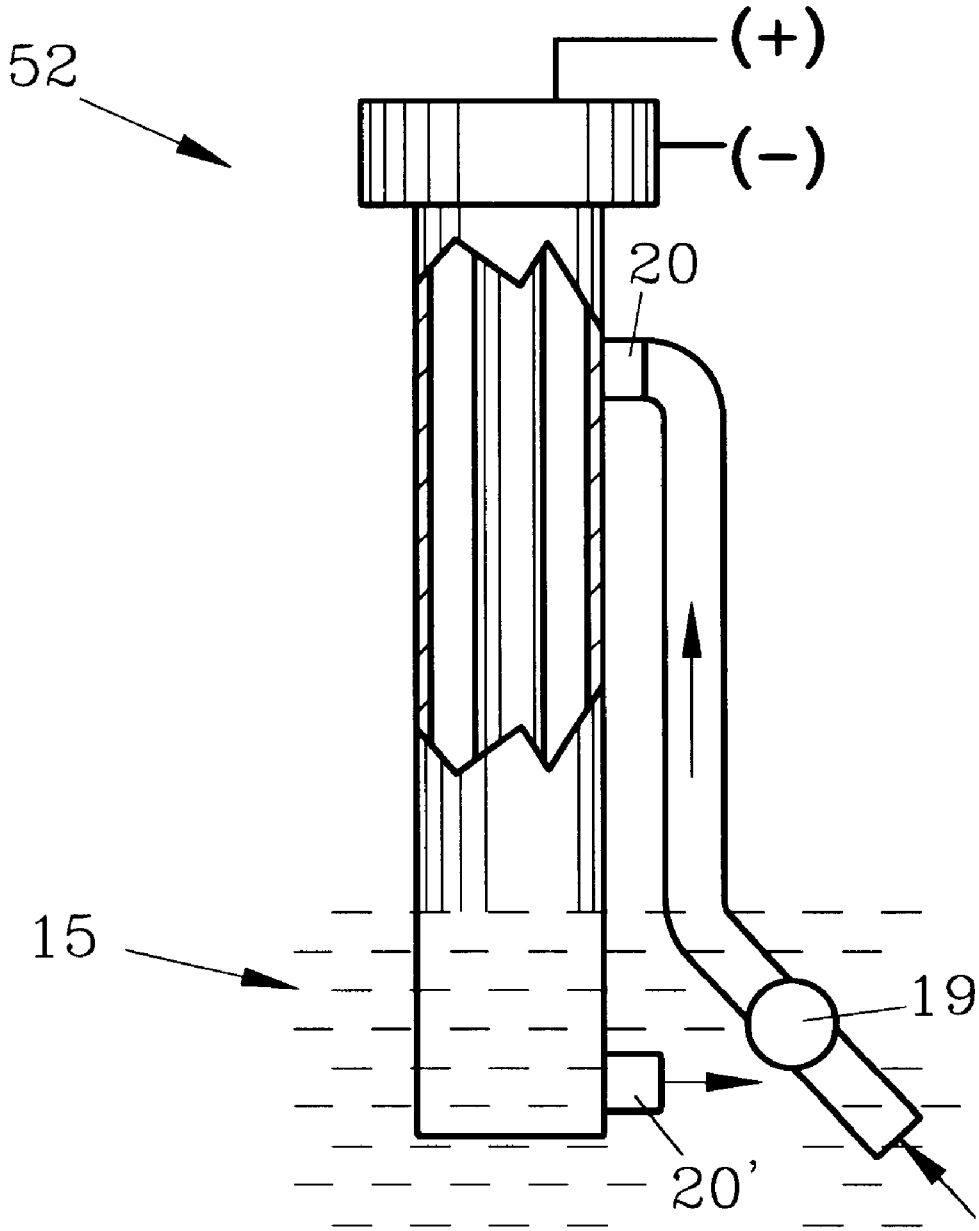
FIG. 7 provides a view of an alternate germicidal system using a copper/silver ionization chamber.

For a better understanding of the invention and its method of operation turning now to the drawings, FIG. 1 demonstrates preferred ball washer 10 having a closed washing chamber 11 which contains rotating brushes 12 as is conventional in the industry. Rotating brushes 12 carry balls 13 in a circular path during scrubbing after receiving the same from ball entry conduit 14. Entry conduit 14 receives balls which may be directed by vacuum, pneumatic or manual means (not shown) from for example a typical children's ball pool. Balls entering chamber 11 are thus cleaned by scrubbing action provided by rotating brushes 12 and cleaning fluid 15 which, is preferably water which has been radiated by standard ultraviolet light purifier 16. Ultraviolet light purifier 16 derives electrical power from transformer 17 contained within ball washer 10. As an alternative germicidal treatment, a standard copper/silver ionization chamber may be used as seen in FIG. 7. There, fluid 15 (preferably water) is directed by pump 19 through entry pipe 20 near the top thereof where it flows by gravity downwardly and exits return pipe 20'.

UV lamp 21 as seen in FIG. 1 operates in the 2,000–2,950 A. wavelength range as is conventional for germicidal purposes. Thus, fluid 15 as shown in washing chamber 11, even after extensive use is maintained in a sanitary condition whether by UV radiation or copper/silver ionization.

Figure 2:
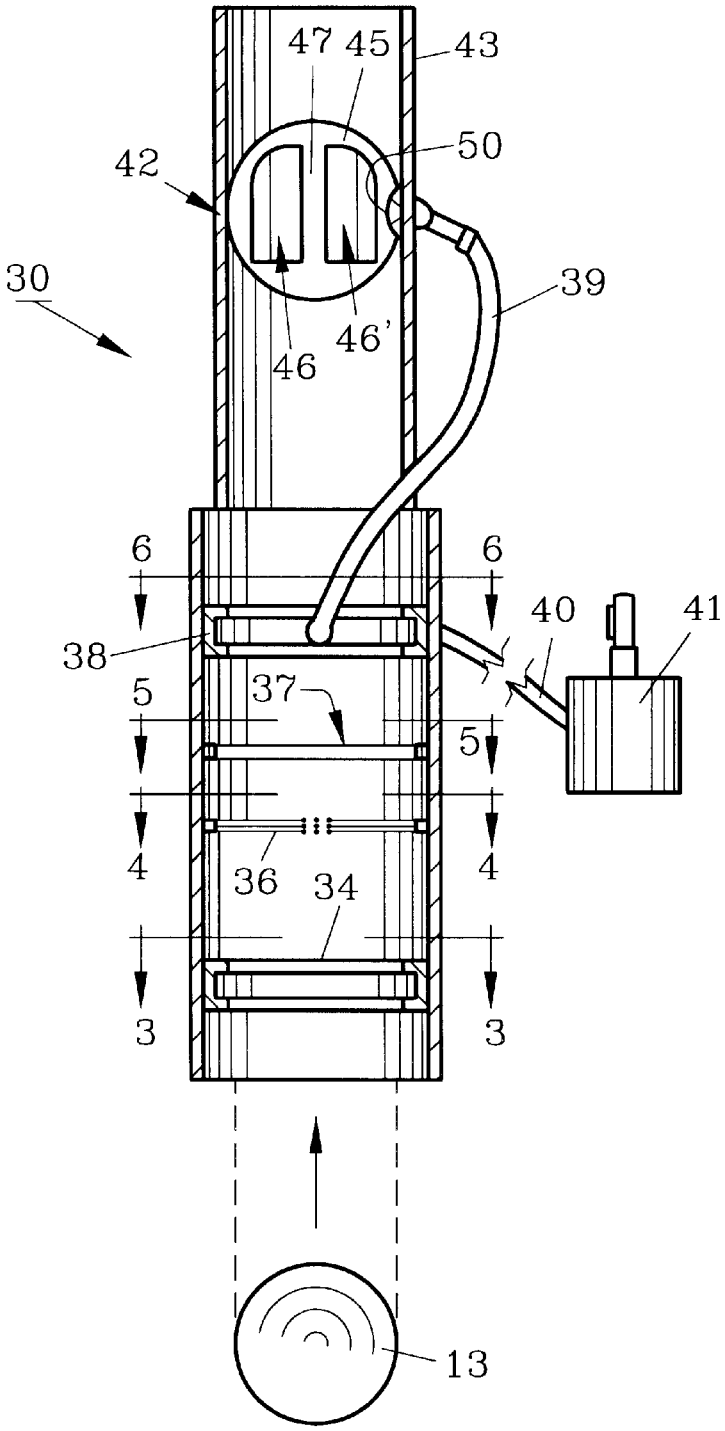
FIG. 2 illustrates the venturi assembly enlarged and removed from the ball washing machine in cut-away fashion.
Figure 3:
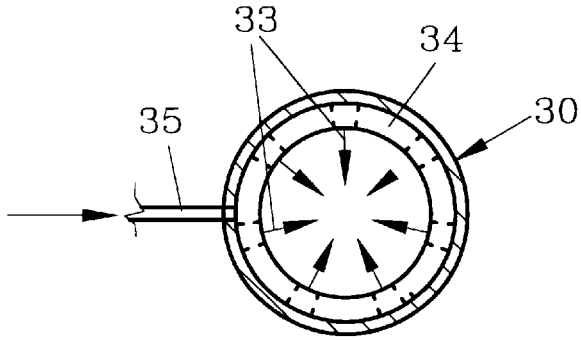
FIG. 3 features a top view of the rinsing ring as shown along lines 3—3 of FIG. 2.
Figure 5:
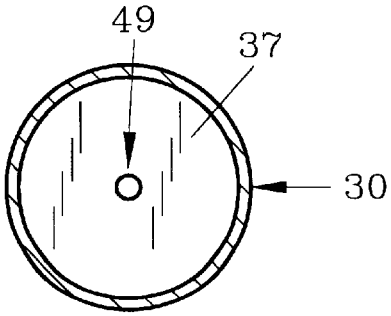
FIG. 5 pictures a view of the elastomeric diaphragm as seen along lines 5—5 of FIG. 2.
Figure 4:
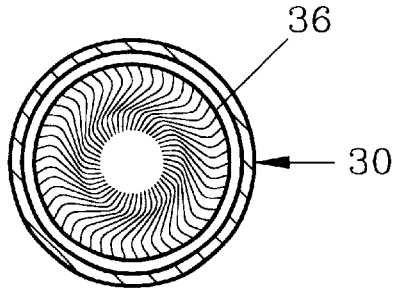
FIG. 4 demonstrates a view of the brush as shown in the venturi assembly along lines 4—4 of FIG. 2.
Figure 6:
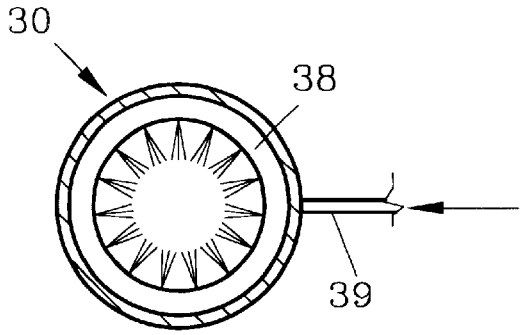
FIG. 6 depicts a view of the air knife of the invention as shown along lines 6—6 of FIG. 2.

Balls 13 thus treated in the preferred method are directed from washing chamber 11 by mechanical action of brushes 12 through exit conduit 24 to venturi assembly 30. Venturi assembly 30 provides the pneumatic force required to urge balls 13 back to a ball pool or other location through ball return conduit 48. Upon exiting washing chamber 11, balls 13 enter venturi assembly 30 which provides a means to rinse and dry balls 13 as shown in enlarged FIG. 2. Balls 13 encounter rinse ring 34 then brush 36 having circularly arranged bristles as shown in FIG. 4 which wipe excess moisture from each ball 13 as it passes through. Balls 13 move further upwardly through venturi assembly 30 and next encounter diaphragm 37 preferably formed of a resilient, elastomeric polymer although natural rubber could be used. Opening 49 expands to allow balls 13 to pass through while diaphragm 37 wipes each ball 13. Next, air knife 38 is confronted (FIG. 5) utilizing air which is delivered by air hose 39 or air hose 40 (FIG. 2), or both as needed. Air hose 40 is joined to a conventional air compressor 41. Air hose 39 receives air from scoop 50 which enters venturi assembly 30 via high pressure air line 42 (FIG. 1). Air scoop 50 receives part of the high pressure air stream from air line 42 and directs it via hose 39 to air knife 38 for drying purposes as earlier explained. Air line 42 sends a high pressure stream of air from a blower (not seen) or otherwise into ball conduit 43 with sufficient force to direct ball 13 back to the ball pool or other desired location. Air passing along air line 42 as shown in FIG. 1 exits at about forty-five degrees to the longitudinal axis of ball conduit 43 through grate 45 and increases in velocity entering ball conduit 43 as it passes through openings 46, 46'. Openings 46, 46' are separated by divider 47 which prevents balls 13 from inadvertently entering air line 42 and causing jams. Balls 13 are returned to a ball pool (not shown) or other destination.

Venturi assembly 30 may optionally utilize a water 33 rinse with rinsing ring 34 connected to water line 35 for "in-line" cleaning systems whereby a germicidal treatment such as ultraviolet irradiated water is constantly cycled through washing chamber 11 as opposed to a self-contained washing chamber as shown in FIG. 1 with contained cleaning fluid 15.

The illustrations and examples provided herein are for explanatory purposes and are not intended to limit the scope of the appended claims.

I claim:

1. A venturi assembly for a ball washer comprising: a ball conduit, an air line, a divider, said divider positioned in said air line to separate air passing therethrough, said air line communicating with said ball conduit to urge a ball through said conduit, and a brush, said brush positioned within said conduit for removing water from a ball passing therethrough.

2. The venturi assembly of claim 1 further comprising an air knife, said air knife within said ball conduit for drying water from a ball.

3. The venturi assembly of claim 2 further comprising an air hose, said air hose connected to said air knife and to said conduit proximate said air line for receiving air flowing through said air line for directing the same along said air hose to said air knife.

4. A ball washing machine comprising a washing chamber, a rotating brush, said rotating brush contained within said chamber, an entry conduit, a ball exit conduit, said ball entry and said ball exit conduits each in communication with said washing chamber, and a means to irradiate water, said water irradiating means contained within said chamber.

5. The ball washing machine of claim 4 wherein said irradiating means comprises an ultraviolet light source.

* * * * *